US006845169B2

(12) United States Patent
Ishigaki

(10) Patent No.: US 6,845,169 B2
(45) Date of Patent: Jan. 18, 2005

(54) SPEAKER PARTS AND METHOD OF MANUFACTURING SAME

(75) Inventor: Toshihiro Ishigaki, Yamagata-ken (JP)

(73) Assignees: Pioneer Corporation, Tokyo (JP); Tohoku Pioneer Corporation, Yamagata-ken (JP)

( * ) Notice: Subject to any disclaimer, the term of this patent is extended or adjusted under 35 U.S.C. 154(b) by 0 days.

(21) Appl. No.: 10/124,259

(22) Filed: Apr. 18, 2002

(65) Prior Publication Data

US 2002/0170774 A1 Nov. 21, 2002

(30) Foreign Application Priority Data

Apr. 19, 2001 (JP) ..... 2001-121280

(51) Int. Cl.[7] ..... H04R 1/00; H04R 7/00

(52) U.S. Cl. ..... 381/426; 381/424; 381/428; 181/169; 181/172

(58) Field of Search ..... 381/423, 424, 381/426, 427, 430, 431, 432, 428; 181/167, 168, 169, 171, 172; 264/108, 113, 114, 115, 121, 122

(56) References Cited

U.S. PATENT DOCUMENTS

| | | | | | |
|---|---|---|---|---|---|
| 3,905,448 | A | * | 9/1975 | Kawakami et al. | 181/172 |
| 4,229,397 | A | * | 10/1980 | Fukuta et al. | 264/113 |
| 5,180,785 | A | * | 1/1993 | Uryu et al. | 525/240 |
| 6,378,649 | B1 | * | 4/2002 | Inoue et al. | 181/167 |
| 6,390,232 | B1 | * | 5/2002 | Kirschbaum | 181/169 |

* cited by examiner

*Primary Examiner*—Curtis Kuntz
*Assistant Examiner*—Brian Ensey
(74) *Attorney, Agent, or Firm*—Arent Fox

(57) ABSTRACT

A speaker edge is molded of a rubber material with 0.1 wt % to 10 wt % short fibers added to the rubber material which ranges from 1.0 mm to 10 mm in length and are resistant to softening by heat, in which the short fibers are oriented to the radial direction of the edge.

4 Claims, 5 Drawing Sheets

PROPER OPERATION

EDGE SUCTION

SPEAKER PARTS AND METHOD OF MANUFACTURING SAME

BACKGROUND OF THE INVENTION

1. Field of the Invention

The invention relates to speaker parts, particularly, elastic parts for supporting a part for a vibration system, and a method of manufacturing the speaker parts.

The present application claims priority from Japanese Application No. 2001-121280, the disclosure of which is incorporated herein by reference for all purposes.

2. Description of the Related Art

Conventionally, an elastic part for supporting a vibration system part of a speaker, for example, an edge which is attached on the rim of a diaphragm to support the diaphragm with respect to a frame so as to permit it to vibrate, is manufactured with use of a rubber material, e.g., IIR (isobutylene-isoprene rubber), SBR (styrene-butadiene rubber) type, NBR (acrylonitrile-butadiene rubber), EPDM (ethylene-propylene-ethylenenorbornene rubber). The rubber material used has 50 degrees, 60 degrees, 70 degrees or 80 degrees of hardness in the main.

However, the edge formed from such a conventional rubber material has the problem of causing serious difficulties in fine-tuning because variations in the types and/or hardness of the rubber used for the edge effect significant changes in the sound quality of the speaker.

A speaker is typically constructed by installing a diaphragm and a magnetic circuitry unit inside a speaker box. With this mode of construction, in the outputting of sound, when the vibration of the diaphragm pushes the diaphragm toward the front of the speaker box (i.e., outward from the inside of the speaker box), the air pressure inside the speaker box becomes a negative pressure in relation to the outside air.

Thus, in the case of the vibration of the diaphragm toward the front, a force acts on the edge supporting the diaphragm with respect to the frame, so as to retract the edge toward the inside of the speaker box.

Therefore, in a speaker used in an environment at high temperatures, for example, in a vehicle-mounted speaker, when a conventional rubber material for forming the edge is softened by high temperatures, the rubber material loses the strength required to maintain the shape of the edge in the face of the pressure differential between the inside and the outside of the speaker box generated during the vibration of the diaphragm.

Thus, such an edge is unable to respond to the vibration of the diaphragm, which may result in the occurrence of a so-called "suction" phenomenon in which the edge is sucked toward the interior of the speaker box.

That is to say, as shown in FIGS. 8A to 8C, an edge 1 is interposed between a diaphragm 3 and a frame 2 in order to support the diaphragm 3 with respect to the frame 2 so as to allow the diaphragm 3 to vibrate in an inside-outside direction of the speaker box (i.e. in the vertical direction in FIG. 8).

In the condition that the edge 1 maintains its shape of bulging toward the outside of the speaker box (toward the upper side in FIG. 8) as illustrated in FIG. 8, the edge 1 holds the diaphragm 3 in the proper vibration state of between a vibration position toward the interior of the speaker box as shown in FIG. 8B and a vibration position toward the outside of the speaker box as shown in FIG. 8C, with a set position in FIG. 8A between.

However, when the rubber material for forming the edge 1 is softened in the high-temperature environment to decrease the strength of the edge 1, as illustrated in FIG. 9, the edge 1 is retracted toward the interior of the speaker box (toward the lower side in FIG. 9) by the pressure differential between the inside and outside of the speaker box which is generated by the vibration of the diaphragm 3. As a result, the diaphragm 3 is supported by a deformed edge 1 during the vibration between a vibration position toward the interior of the speaker box shown in FIG. 9B and a vibration position toward the outside shown in FIG. 9C, with the set position shown in FIG. 9A between.

This creates the problem of disabling the proper vibration of the diaphragm 3 so as to produce a defective sound or to become a cause of failure.

In particular, in addition to the requirement of reducing the size of speaker boxes due to the downsizing of audio systems, recent years have seen advances in the powering of speakers. This causes an increase in the pressure differential between the inside and outside of the speaker box during the vibration of the diaphragm, leading to a serious problem of the "suction" of the edge as described above.

SUMMARY OF THE INVENTION

The present invention has been made to solve the above problems associated with the conventional elastic parts for supporting the vibration system part of the speaker as described thus far.

It is therefore a first object of the present invention to provide speaker parts capable of supporting a vibration system part in a proper vibration state even in a high-temperature environment.

Further, it is a second object of the present invention to provide a method of manufacturing speaker parts allowing the attainment of the first object.

To attain the first object, a speaker part according to a first aspect of the present invention has the feature of a rubber material with short fibers of from 1.0 mm to 10 mm in length added to the rubber material and orientated in a predetermined direction, for molding the speaker part.

For manufacture of the speaker part according to the first aspect, the short fibers having a length ranging from 1.0 mm to 10 mm are added to and mixed into the rubber material serving as a base material of the speaker elastic-part for supporting a vibration system part of the speaker, for example, an edge. After that, the resulting rubber material is pressed and stretched such that the short fibers are oriented in the predetermined direction of the speaker part, and is molded into a required shape of the speaker part.

According to the first aspect, therefore, due to the short fibers which are added to the rubber material serving as the base material of the speaker part and are oriented in the required direction, the speaker part is improved in rigidity in the orientation direction of the short fibers and becomes resistant to softening even in a high-temperature environment. Hence, the speaker part is prevented from being deformed by the pressure differential between the inside and outside of the speaker box generated by the vibration of the diaphragm.

The physical properties of the speaker part such as rigidity and anti-softening properties can be selectively controlled by means of the adjustment of the types or lengths of the short fibers, the amount of the short fibers added to the rubber material, and the like.

The range of from 1.0 mm to 10 mm in length of the short fiber added to the rubber material permits the rubber material to have the rigidity required for the speaker part and facilitates mixing the short fiber into the rubber material.

To attain the first object, a speaker part according to a second aspect of the present invention has, in addition to the configuration of the first aspect, the feature that the short fibers are added to the rubber material in an amount designed to provide from 0.1 percent by weight to 10 percent by weight of the short fibers in the rubber material.

According to the speaker part of the second aspect, the amount of short fibers added to the rubber material is set to range from 0.1 wt % to 10 wt % with respect to the rubber material. This permits the rubber material to have the rigidity required for the speaker part and facilitates mixing the short fiber into the rubber material. Moreover, the rubber material is prevented from becoming brittle due to the addition of an excessive amount of the short fibers.

To attain the first object, a speaker part according to a third aspect of the present invention has, in addition to the configuration of the first aspect, the feature that the short fibers consist of one item or more selected from the group consisting of aramid fiber, PBO fiber, liquid crystal polymer fiber, metal fiber, acrylic fiber, boron fiber, amorphous fiber, ceramic fiber, silicon carbide fiber, fluorocarbon polymers fiber, acetate fiber, and silk fiber.

According to the speaker part of the third aspect, to the rubber material serving as the base material for forming the speaker part are added short fibers of a type resistant to softening at temperatures higher than that of the rubber material. By this reason, the resulting speaker part is prevented from softening due to a decrease in Young's modulus of the rubber material in a high-temperature environment, leading to prevention of the speaker part from being deformed by an external force acting on the speaker part.

Further, selecting the short fibers to be added to the rubber material from the above group yields the prevention of the short fibers from being broken up when the short fibers are mixed into the rubber material to cause a degradation in the anti-softening effect of the short fibers in a high-temperature environment.

To attain the first object, a speaker part according to a fourth aspect of the present invention has, in addition to the configuration of the first aspect, the feature that the rubber material principally consists of at least one item selected from the group consisting of IIR, NBR, SBR, EPDM, chloroprene rubber, isoprene rubber, ethylene-propylene rubber, poly-norbornene rubber, silicone rubber, epichlorohydrin rubber, and natural rubber. To the above rubber material are added the short fibers for molding of the speaker part.

To attain the first object, a speaker part according to a fifth aspect of the present invention has, in addition to the configuration of the first aspect, the feature that the speaker part molded of the rubber material is an edge for supporting a diaphragm, and the short fibers are oriented approximately along the radial direction of the edge.

According to the speaker part of the fifth aspect, the edge, which is attached to the rim of the diaphragm of the speaker and supports the diaphragm in relation to a frame so as to permit the diaphragm to vibrate, is formed by means of the addition of the short fibers resistant to softening at high temperatures are added to the rubber material serving as the base material of the edge, and of the orientation of such short fibers in the radial direction of the edge. Such addition and orientation effect an improvement in the rigidity in the radial direction of the edge and the resistance of the edge to softening even in a high-temperature environment, leading to the prevention of the occurrence of the so-called "suction" phenomenon in which the edge is deformed resulting from being retracted toward the interior of the speaker box by the pressure differential between the inside and outside of the speaker box generated in connection with the vibration of the diaphragm.

To attain the second object, a method of manufacturing a speaker part according to a sixth aspect of the present invention has the feature of including the steps of: a mixing process for mixing a rubber material with short fibers of from 1.0 mm to 10 mm in length added to the rubber material, by use of rollers to orient the short fibers in the sending direction of the rollers; a producing process for cutting the rubber material, mixed in the above mixing process, in a direction approximately perpendicular to the orientation direction of the short fibers to produce a rubber compound having a predetermined width; and a pressing process for pressing the rubber compound produced in the producing process to stretch the rubber compound approximately in the orientation direction of the short fibers to mold the rubber compound into a required shape of the speaker part.

With the method of manufacturing a speaker part of the sixth aspect, first, in the mixing process, the short fibers having a length of from 1.0 mm to 10 mm are added to and mixed into the rubber material and the rubber material is pressed and stretched by use of the rollers, thereby orienting the added short fibers in the direction of the sending of the rubber material by the rollers.

Then, in the producing process, the rubber material mixed in the mixing process is cut in a direction approximately perpendicular to the orientation direction of the short fibers to produce a rubber compound having a predetermined width. Then in the pressing process, the resulting rubber compound is pressed to be stretched in a direction approximately along the orientation direction of the short fibers, thereby molding the speaker part having a required shape.

According to the sixth aspect, in addition to adding the short fibers to the rubber material serving as the base material of the speaker part, it is possible to facilitate the orienting of the short fibers in a required direction. Thus, the rigidity in the orientation direction of the short fibers is increased to allow the provision of a speaker part which is resistant to softening even in a high-temperature environment, and therefore is not deformed from the normal shape by the pressure differential between the inside and outside of the speaker box generated by the vibration of the diaphragm.

To attain the second object, a method of manufacturing a speaker part according to a seventh aspect of the present invention has, in addition to the configuration of the sixth aspect, the feature that in the mixing process, the short fibers are added to the rubber material in an amount designed to provide from 0.1 percent by weight to 10 percent by weight of the short fibers in the rubber material.

According to the method of manufacturing the speaker part of the seventh aspect, in the mixing process, the amount of short fibers added to the rubber material is set to range from 0.1 wt % to 10 wt % with respect to the rubber material. This permits the rubber material to have the rigidity required for the speaker part and facilitates mixing the short fibers into the rubber material. Moreover, the rubber material is prevented from becoming brittle due to the addition of an excessive amount of short fibers.

To attain the second object, a method of manufacturing a speaker part according to an eighth aspect of the present invention has, in addition to the configuration of the sixth aspect, the feature that in the mixing process, to the rubber material are added the short fibers of one item or more selected from the group consisting of aramid fiber, PBO fiber, liquid crystal polymer fiber, metal fiber, acrylic fiber, boron fiber, amorphous fiber, ceramic fiber, silicon carbide fiber, fluorocarbon polymers fiber, acetate fiber, and silk fiber.

According to the method of manufacturing the speaker part of the eighth aspect, in the mixing process, to the rubber material serving as the base material for forming the speaker part are added the short fibers of a type resistant to softening at temperatures higher than that of the rubber material. This causes a smaller decrease in Young's modulus of the rubber material in a high-temperature environment, resulting in the provision of the speaker part to be less deformed by an external force.

Further, the selection of the short fibers to be added to the rubber material from the above group yields the prevention of the short fibers added to the rubber material in the mixing process from being broken up to cause a degradation in the anti-softening effect of the short fiber in a high-temperature environment.

To attain the second object, a method of manufacturing a speaker part according to a ninth aspect of the present invention has, in addition to the configuration of the sixth aspect, the feature that in the mixing process, the short fibers are added to the rubber material principally consisting of at least one item selected from the group consisting of IIR, NBR, SBR, EPDM, chloroprene rubber, isoprene rubber, ethylene-propylene rubber, poly-norbornene rubber, silicone rubber, epichlorohydrin rubber, and natural rubber. In the mixing process, the short fibers are added to the above rubber material for the molding of the speaker part.

To attain the second object, a method of manufacturing a speaker part according to a tenth aspect of the present invention has, in addition to the configuration of the sixth aspect, the feature that in the producing process, the rubber material with the short fibers added to and mixed into the rubber material is cut in a direction approximately perpendicular to the orientation direction of the added short fibers to produce a band-shaped rubber compound, and then in the pressing process, the band-shaped rubber compound is loaded annularly into a cavity face of a die and then pressed to stretch in the width direction of the rubber compound for molding of a shape of an edge for supporting a diaphragm of the speaker.

According to the method of manufacturing the speaker part of the tenth aspect, the rubber material, to which the short fibers have been added and oriented in a single direction in the processes before proceeding to the producing process, is cut in the producing process in a direction approximately perpendicular to the orientation direction of the short fibers to produce a band-shaped rubber compound. Then, the band-shaped rubber compound is loaded into the cavity face of one of dies in a ring shape for the longitudinal direction of the rubber compound to come in the circumferential direction. Then, the loaded rubber compound is pressed by the other die to mold a speaker edge of a shape corresponding to the cavity faces.

In the pressing of the dies, the rubber compound loaded into the cavity is pressed and stretched in the radial direction of the ring. As a result, the short fibers added to the rubber material are additionally oriented so as to be along the radial direction.

Thus, this method allows the manufacturing of an edge with improved rigidity in the radial direction, resistant to softening in a high-temperature environment, and capable of preventing the occurrence of the so-called "suction" phenomenon in which the edge is deformed by being retracted toward the interior of the speaker box by the pressure differential between the inside and outside of the speaker box generated in connection with the vibration of the diaphragm.

These and other objects and advantages of the present invention will become obvious to those skilled in the art upon review of the following description, the accompanying drawings and appended claims.

DETAILED DESCRIPTION OF THE PREFERRED EMBODIMENT

A preferred embodiment according to present invention will be described below using an edge, which is a vibration system part for a speaker, by way of example.

The speaker edge according to the embodiment of the present invention is formed from a rubber material principally consisting of at least one item selected from the group consisting of synthetic rubber, such as IIR, NBR, SBR, EPDM, chloroprene rubber, isoprene rubber, ethylene-propylene rubber, poly-norbornene rubber, silicone rubber and epichlorohydrin rubber, and natural rubber.

To the rubber material are added 0.1 wt % to 10 wt % of short fibers having a length of from 1.0 mm to 10 mm which are one item or more selected from the group consisting of aramid fiber, PBO fiber, liquid crystal polymer fiber, metal fiber, acrylic fiber, boron fiber, amorphous fiber, ceramic fiber, silicon carbide fiber, fluorocarbon polymers fiber, acetate fiber, and silk fiber, for example.

Figure 1:
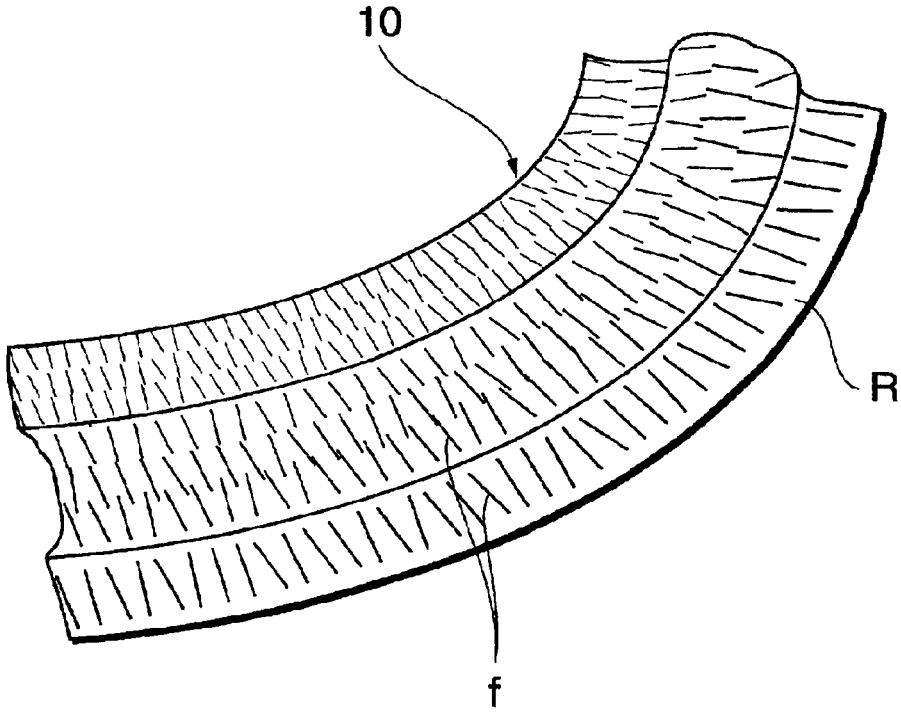
FIG. 1 is a partially perspective view illustrating an edge in an embodiment according to the present invention.

As illustrated in FIG. 1, the short fibers f are oriented within the rubber material R, molded into a shape of the edge 10, in the radial direction of the edge 10.

In the case of the edge 10, to the rubber material R serving as a base material are added fibers of various types, as described above, resistant to softening at higher temperatures than that of the rubber material. The added short fibers f are oriented in the radial direction of the edge 10, to allow the edge to improve the rigidity in the radial direction and to be resistant to softening in a high-temperature environment, leading to the prevention of the edge from undergoing the so-called "suction" phenomenon.

The physical properties of such an edge 10 such as rigidity and anti-softening property are selectively adjusted by means of the adjustment of the types, lengths or the amount of addition of the short fibers f, in conformity with the characteristics of the speaker using the edge 10.

When the short fibers f added to the rubber material R have a fiber length of shorter than 1.0 mm, it is impossible to make much improvement in the rigidity in the radial direction of the edge 10, whereas when they have a fiber length of longer than 10 mm, it is difficult to mix the short fibers f with the rubber material R, thus the preferable fiber-length is within a range of from 1.0 mm to 10 mm as described above.

When the amount of short fibers f added to the rubber material R serving as the base material exceeds 10 wt %, it is difficult to mix the short fiber f into the rubber material R and problems such as the rubber material R becoming brittle are produced. As described above, the amount of addition of the short fibers is preferably set at from 0.1 wt % to 10 wt % with respect to the rubber material R.

One possible idea is the use of carbon fiber for the short fibers f to be added to the rubber material R. However, in the case of the addition of carbon fiber, the carbon fibers are broken up during the mixing into the rubber material, and therefore the rigidity of the edge 1 cannot be much improved. In addition, if the carbon fibers are broken into pieces of less than or equal to one millimeter, the characteristics of the rubber material become predominant in the physical properties of the edge so that it is impossible to expect an anti-softening effect in a high-temperature environment. Thus, it is preferable to select the short fibers f added to the rubber material R from the group consisting of fibers as described above.

Next, a method of manufacturing the above edge 1 will be described with reference to FIG. 2 to FIG. 5.

For manufacturing the edge 1, first a rubber material R and short fibers f are optionally selected from the respective groups of rubber materials and fibers as listed above. The short fibers f of from 1.0 mm to 10 mm in length are added to the selected rubber material R in an amount designed to provide from 0.1 wt % to 10 wt % of the short fibers f in the rubber material R, and then mixed into the rubber material R.

Figure 2:
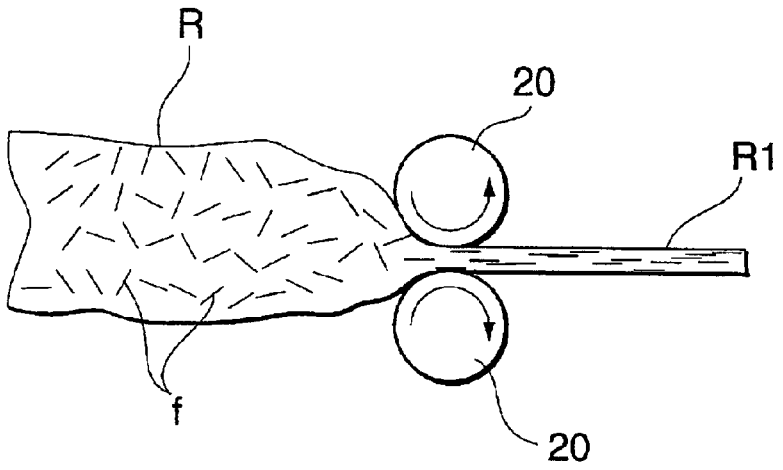
FIG. 2 is a view for explaining a mixing process in the manufacturing of the edge.

As illustrated in FIG. 2, the rubber material R with the short fibers f mixed into is passed between a pair of rollers 20 to be stretched into a sheet form.

Figure 3:
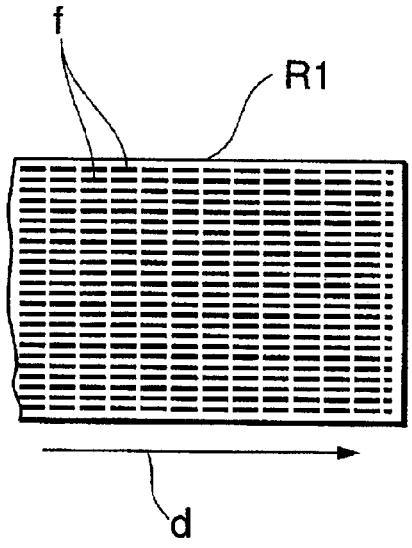
FIG. 3 is a diagram for explaining short fibers oriented in a single direction in the mixing process.

Through the rolling of the rubber material R between a pair of rollers 20 to stretch it along the sending direction of the rollers 20, as illustrated in FIG. 3, each of the short fibers f mixed into the rubber material R is oriented in the stretching direction d within a sheet R1 of the rubber material R.

Figure 4:
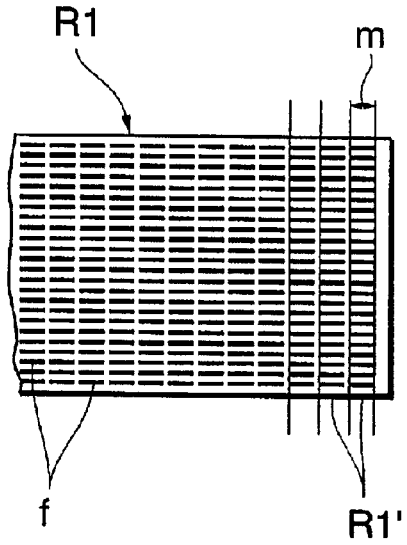
FIG. 4 is a diagram for explaining a process for producing a rubber compound for manufacturing the edge.
Figure 5:
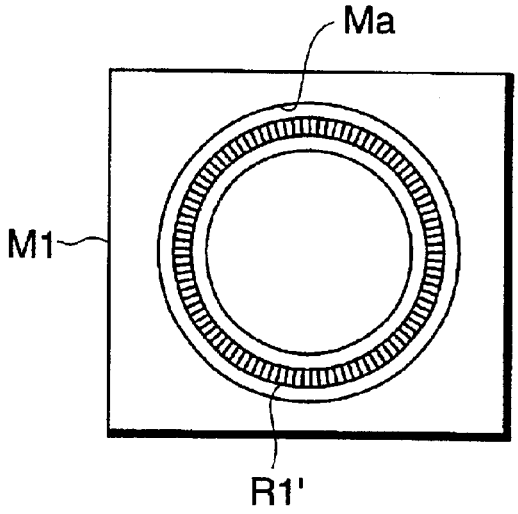
FIG. 5 is a diagram for explaining the rubber compound loaded into a die.

Then, as illustrated in FIG. 4, the sheet R1 of the rubber material R is cut into band-shaped pieces having a required width m in a direction at right angles to the stretching direction d, or a direction perpendicular to the orientation direction of the fibers f. Then, as illustrated in FIG. 5, the resulting band R1' of the rubber material R is shaped into a ring-like form and loaded into a circular-shaped cavity face Ma formed in a stationary die M1.

Figure 6:
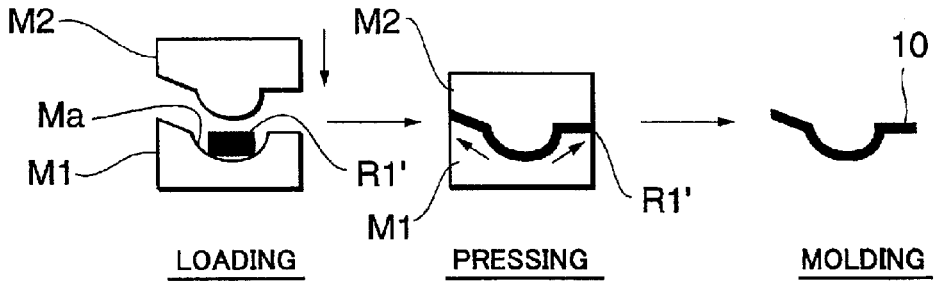
FIGS. 6A to 6C are diagrams for explaining a process for pressing the rubber compound.

FIG. 6A illustrates the band (rubber compound of unvulcanized rubber) R1' loaded into the cavity face Ma of the stationary die M1. As illustrated in FIG. 6B, the rubber compound R1' in the cavity face Ma is then pressed by a movable die M2 to be molded into an edge 10 of semicircular section as illustrated in FIG. 6C (see FIG. 1).

At this point, the press pressure of the stationary die M1 and movable die M2 effects a flow of the rubber compound R1' inward and outward in a radial direction along the cavity faces of the dies, leading to an additional orientation of the short fibers f added to the rubber material R in the radial direction of the edge 10.

In this way, as illustrated in FIG. 1, the edge 10 having the short fibers f oriented in the radial direction within the rubber material R is molded.

The orientation of the short fibers f in the radial direction within the rubber material R can be achieved to some extent simply by the dies pressing the rubber compound resulting from mixing the short fiber f into the rubber material R. However, when the amount of short fibers f is large or the rubber material R is hard, the orientation of the short fibers f cannot be satisfactorily controlled, and therefore due to variations in the orientation the edge may not be shaped exactly as required.

However, with the molding of the edge 10 by the foregoing process, even in the cases of a large amount of short fibers f, a great length of the short fibers f, a high hardness of the rubber material R, and the like, it becomes possible to effectively orient the short fibers f within the edge 10 in the radial direction.

Figure 7:
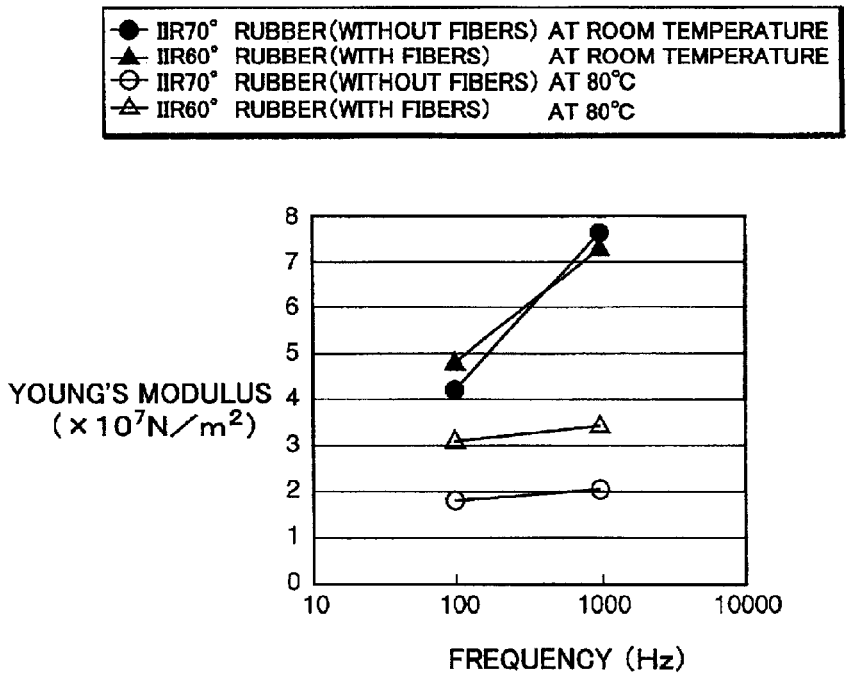
FIG. 7 is a graph showing variations in Young's modulus of the rubber material with the added short fibers in relation to temperatures.
Figure 8:
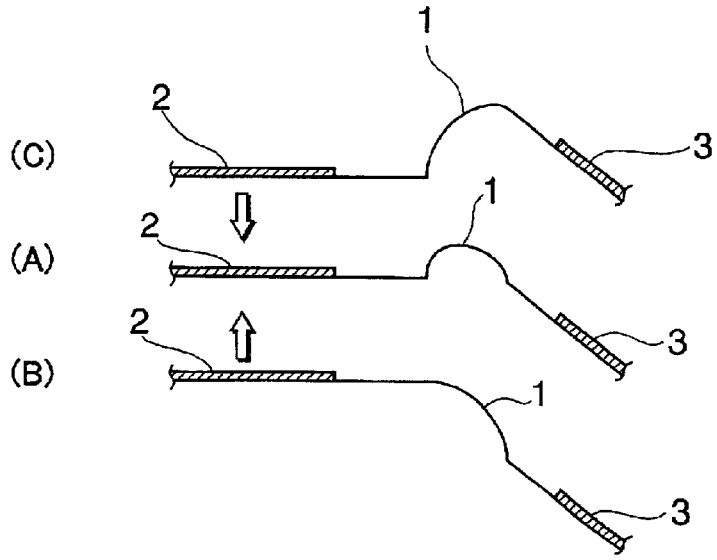
FIGS. 8A to 8C are views for explaining a proper operation of a speaker edge.
Figure 9:
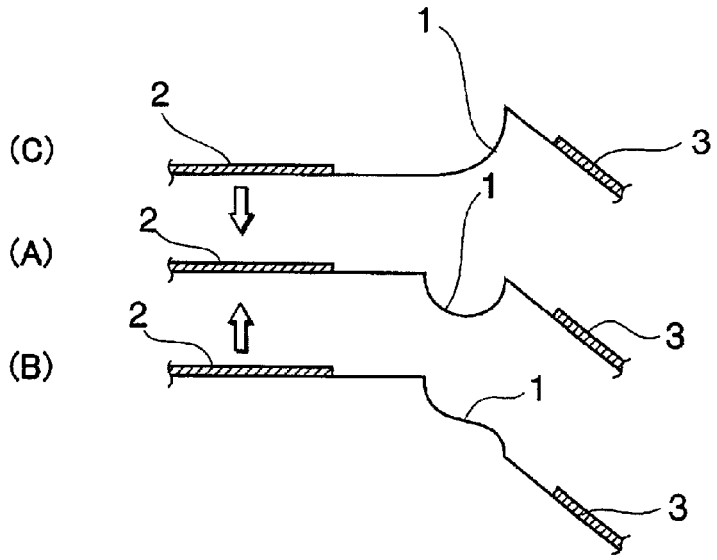
FIGS. 9A to 9C are views for explaining an operation of a speaker edge when suction is produced.

FIG. 7 shows a graph of Young's modulus in the radial direction of the edge 10 molded of IIR 70 degrees (a rubber material without fibers) and IIR 60 degrees (a rubber material with fibers), in relation to frequency.

An IIR 60 degrees rubber material with fibers is produced by adding 1.5 wt % aramid fiber of 3.0 mm in length to an IIR 60 degrees rubber material. It is seen from FIG. 7 that the aramid fibers is added to the IIR 60 degrees rubber material and orientated to increase the rigidity of the rubber material, and therefore the resulting rubber material has Young's modulus approximately equal to that of the IIR 70 degrees rubber material without fiber, for each frequency at room temperature (23 degrees C.).

For checking the degree of softening in a high-temperature environment, the conditions of the rubber materials of the IIR 70 degrees (rubber material without fibers) and the IIR 60 degrees (rubber material with fibers) under environment at 80 degrees C. are compared. It is seen that the IIR 60 degrees (rubber material with fibers) has a reduction in Young's modulus smaller than that of the IIR 70 degrees (rubber material without fibers) and the edge 10 molded of the IIR 60 degrees rubber material with fiber is resistant to softening in a high-temperature environment.

In consequence, it is understood that the molding of a speaker edge of a rubber material with fibers allows effective prevention of the occurrence of the so-called "suction" phenomenon on the edge in a high-temperature environment.

The terms and description used herein are set forth by way of illustration only and are not meant as limitations. Those skilled in the art will recognize that numerous variations are possible within the spirit and scope of the invention as defined in the following claims.

What is claimed is:

1. A speaker part, comprising a rubber material with short fibers of from 1.0 mm to 10 mm in length added to the rubber material and orientated in a predetermined direction, for molding the speaker part;

wherein said short fibers consist of one item or more selected from the group consisting of aramid fiber, PBO fiber, liquid crystal polymer fiber, metal fiber, acrylic fiber, boron fiber, amorphous fiber, ceramic fiber, silicon carbide fiber, fluorocarbon polymers fiber, acetate fiber, and silk fiber.

2. A speaker part according to claim 1, wherein said short fibers are added to said rubber material in an amount designed to provide from 0.1 percent by weight to 10 percent by weight of the short fibers in the rubber material.

3. A speaker part according to claim 1, wherein said rubber material principally consists of at least one item selected from the group consisting of IIR, NBR, SBR, EPDM, chloroprene rubber, isoprene rubber, ethylene-propylene rubber, poly-norbornene rubber, silicone rubber, epichlorohydrin rubber, and natural rubber.

4. A speaker part according to claim 1, wherein said speaker part molded of said rubber material is an edge for supporting a diaphragm, and said short fibers are oriented approximately along the radial direction of the edge.

* * * * *